US005857394A

United States Patent [19]

Gaggio

[11] Patent Number: 5,857,394

[45] Date of Patent: Jan. 12, 1999

[54] SYSTEM FOR VACUUM-REFEEDING SHEETS, IN PARTICULAR CORRUGATED BOARD SHEETS, TO BE USED IN PRINTING AND DIE CUTTING MACHINES

[75] Inventor: Gianfranco Gaggio, Via Valenza, Italy

[73] Assignee: TEXO s.r.l., Castelletto M.T.O., Italy

[21] Appl. No.: 512,838

[22] Filed: Aug. 9, 1995

[51] Int. Cl.[6] ..... B26B 5/08

[52] U.S. Cl. ..... 83/110; 271/198

[58] Field of Search ..... 271/198, 376; 83/110

[56] References Cited

U.S. PATENT DOCUMENTS

| | | | |
|---|---|---|---|
| 2,481,934 | 9/1949 | Langston | 83/110 |
| 3,053,128 | 9/1962 | Manthey | 83/110 |
| 3,272,351 | 9/1966 | Burton et al. | 271/197 X |
| 3,584,725 | 6/1971 | Richards et al. | 198/732 |
| 3,618,937 | 11/1971 | Follett | 271/197 X |
| 3,680,677 | 8/1972 | Branch et al. | 198/369.6 |
| 3,826,568 | 7/1974 | Hudson | 271/276 |
| 3,848,752 | 11/1974 | Branch et al. | 198/780 X |
| 3,866,906 | 2/1975 | Berry | 271/227 |
| 4,062,532 | 12/1977 | Peter et al. | 281/198 X |
| 4,298,277 | 11/1981 | Silverberg | 271/276 X |
| 4,412,738 | 11/1983 | Ahern et al. | 271/276 X |
| 4,647,033 | 3/1987 | Emrich | 271/276 |
| 4,660,752 | 4/1987 | Rikard et al. | 271/276 X |
| 4,729,181 | 3/1988 | Weir | 271/276 X |
| 4,936,564 | 6/1990 | Hain | 271/198 X |
| 5,014,582 | 5/1991 | Teik | 83/110 X |
| 5,067,762 | 11/1991 | Akashi | 271/97 X |
| 5,076,568 | 12/1991 | De Jong et al. | 271/198 X |
| 5,133,543 | 7/1992 | Eitel et al. | 271/276 |
| 5,183,251 | 2/1993 | Sardella | 271/276 |

FOREIGN PATENT DOCUMENTS 757962 2/1997 European Pat. Off. .

OTHER PUBLICATIONS

Martin S.A. (a European Corporation in the field), "Complete High Productivity Line For The Die–Cutting of Corrugated Board Boxes". All pages are relevant. The exact date and place of publication is unknown. However, the publication was available before Feb. 23, 1994.

*Primary Examiner*—M. Rachuba
*Attorney, Agent, or Firm*—Helfgott & Karas, P.C.

[57] ABSTRACT

A sheet-refeeding system for vacuum-refeeding sheets in printing and die cutting machines includes a supporting structure and a plurality of boxes containing fans, located on the supporting structure above a sheet-conveying line. The system further has sheet-dragging knurled rollers positioned in slits formed in a conveying plate which in turn has rows of small holes to let air pass therethrough. The system has a central conveying line and at least two side lines. Each line has a plurality of idle guide rollers. Longitudinal sheet-guiding plates are installed between the sides of the idle rollers. Toothed belts are positioned between the lines of idle guide rollers. The belts have on their external surfaces small sheet-dragging blocks, which are installed with such pitch and such speed as to adjust a phase of the sheets moving on the belts to the location of a die cutting cylinder installed downstream of the sheet-refeeding system without interference with the rear sides of the sheets.

5 Claims, 3 Drawing Sheets

SYSTEM FOR VACUUM-REFEEDING SHEETS, IN PARTICULAR CORRUGATED BOARD SHEETS, TO BE USED IN PRINTING AND DIE CUTTING MACHINES

BACKGROUND OF THE INVENTION

1. Field of the Invention

The present invention refers to a system for vacuum-refeeding sheets, in particular corrugated board sheets, to be used, for example, in printing and die cutting machines in order to prepare packaging boxes.

2. Description of Rrior Art

Systems of this type are known, in which there is a sheet-transporting device, that connects the printing station to the die cutting station in a rotary printing machine. This sheet-transporting device allows conveying sheets by vacuum, in particular corrugated board sheets or similar sheets, by applying an upward-directed suction force generated by a fan placed inside an upper hood of the system. A horizontal sheet displacement is therefore obtained, where the sheets are grasped by two rubber rollers and then pass, pushed by two belts with small blocks, on idle rollers in contact with the upper face thereof without having to make these sheets pass on cylindric rollers that will make the lower face of the sheets dirty, as soon as a sheet has been printed on by the upstream printing station.

The above-described device has the problem that it has been necessary to have sheets available whose width is greater than the distance between the two belts, so that the belts could push the sheets through the small blocks. Therefore the belts must have been transversally adjusted at every work-change, with obvious operating problems. Furthermore, the belts reduce the available space under the sheets, occupied in this case by a small-sized drying machine, that thereby guarantees a less effective drying operation.

SUMMARY OF THE INVENTION

An object of the present invention is to provide a system for vacuum-conveying sheets in general, and corrugated board sheets in particular, that can be easily manufactured and is immediately effective, even for displacing sheets over long distances. The system of the present invention allows conveying sheets of any thickness and any size greater than the minimum overall thickness and the size pertaining to the machine, and, after printing on the sheets, it allows realigning them and adjusting the speed of the sheets to the one of the following working units of the machine, in which these sheets will be die cut.

The above and other objects and advantages, which will be apparent from the following description, are obtained with a system for vacuum-refeeding sheets of the present invention.

The present invention will be better described by some preferred embodiments, given as non limiting examples, with reference to the enclosed drawings.

DESCRIPTION OF THE PREFERRED EMBODIMENT

Before describing the preferred embodiment of the invention, it is necessary to point out that this can be applied to any sheet-production line in which a conveyance is needed that does not make use of the lower face of the sheets. The preferred embodiment deals with corrugated board sheets in a rotary printing line, but the invention could be applied, for example, to lines for conveying various types of wooden sheets.

Figure 1:
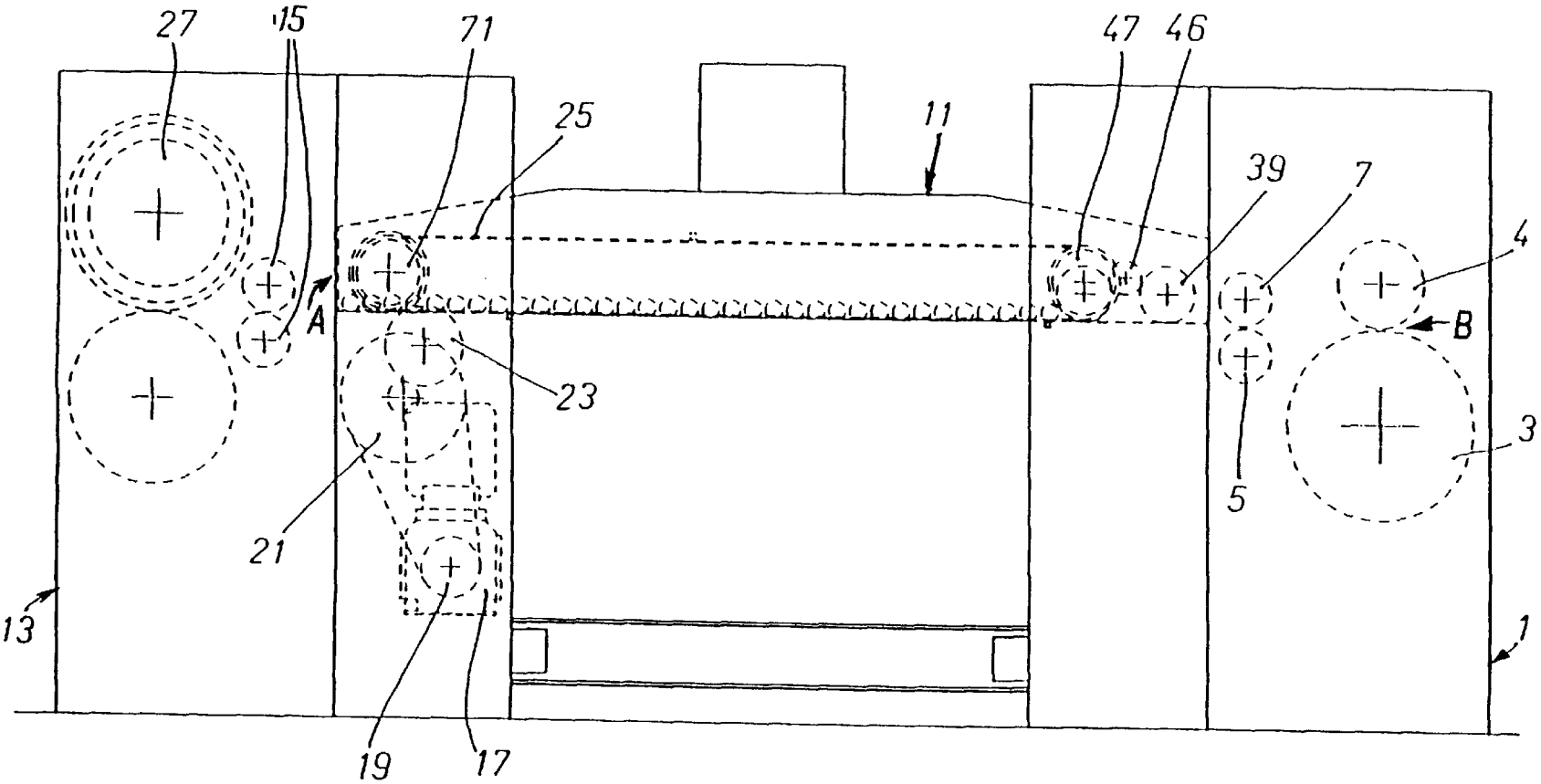
FIG. 1 is a side view of a printing and die cutting line for cardboard sheets, which includes a sheet-refeeding system of the present invention.

The rotary printing line, in the parts thereof dealing with the present invention, is schematically shown in FIG. 1. In this Figure, sheets are traveling along a direction represented by arrow B and are entering a printing unit 1, wherein there are substantially a printing roller 3, a pressure cylinder 4 and a pair of outlet rollers 5 and 7. The outlet roller 5 speed is synchronized with a first knurled roller 39 that is already part of the sheet-refeeding system 11 of the invention, which will be described in detail below. After having entered the refeeding system 11 and having been conveyed by it, the sheets enter a die cutting unit 13 through two inlet rollers 15, that are actuated by a d.c. motor 17 through adequate transmission or drive elements 19, 21 and 23 in the well-known fashion. As shown in FIG. 1, the drive elements 19, 21 and 23 may be formed as a pulley-driven belt unit operatively coupled to the d.c. motor 17. The rotating speed of the inlet rollers 15 is the same as the outlet speed of the sheets from the printing unit 1, and is slightly greater than that of the refeeding system 11, because the d.c. motor 17 also controls rotation of the toothed timing belts 25 of the system 11, which will be described below. The sheets then pass below the die cutter-holding cylinder 27 and are cut and then further conveyed by known devices for the following workings. In the lower part of the refeeding system 11 in FIG. 1, a sheet-drying machine (not shown) is normally installed, that, given the wider space available provided by the arrangement of the toothed timing belts 25 which drag the sheets, guarantees a more complete and effective drying.

Figure 2:
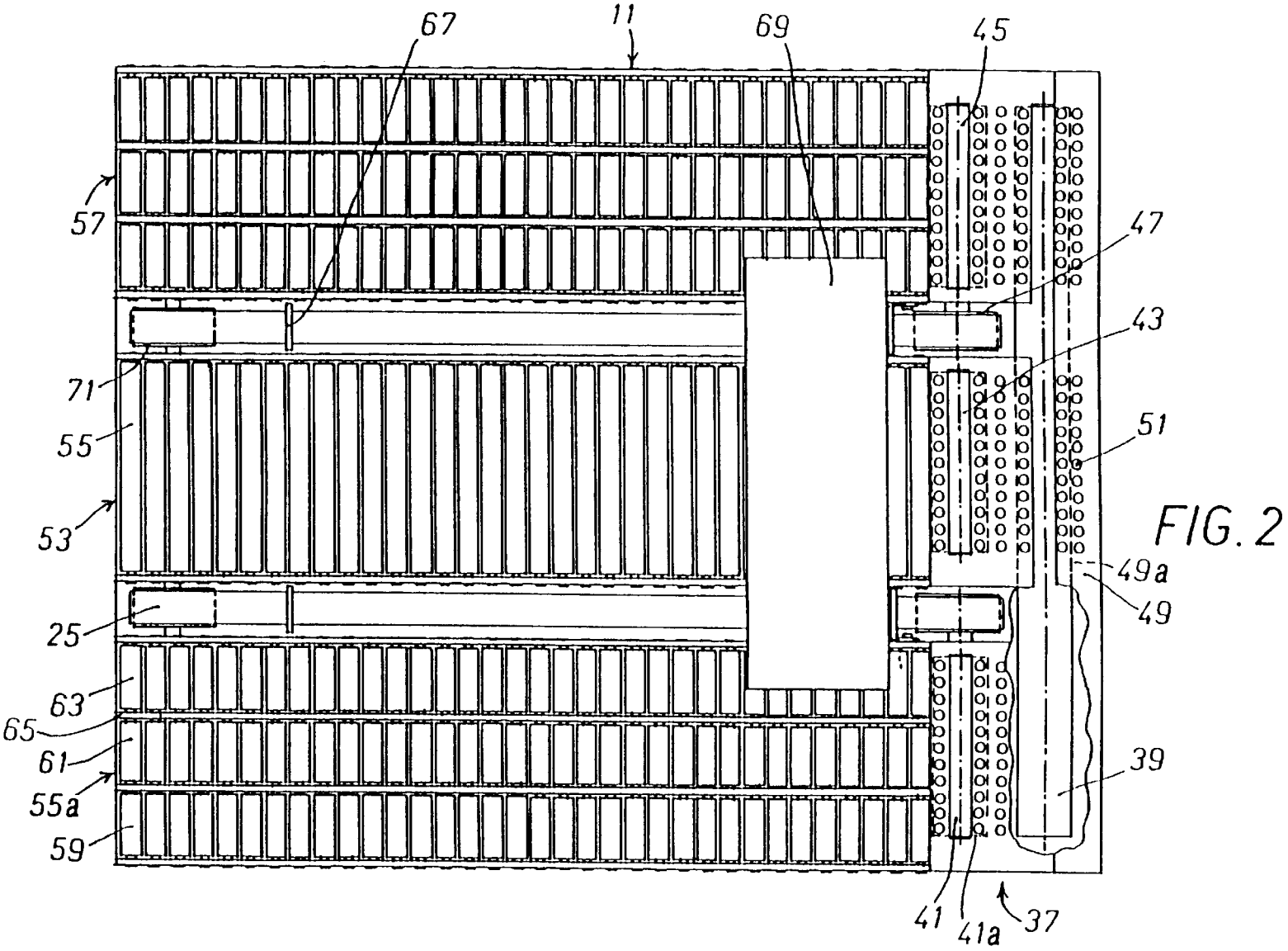
FIG. 2 is a bottom view of the sheet-refeeding system of FIG. 1.
Figure 3:
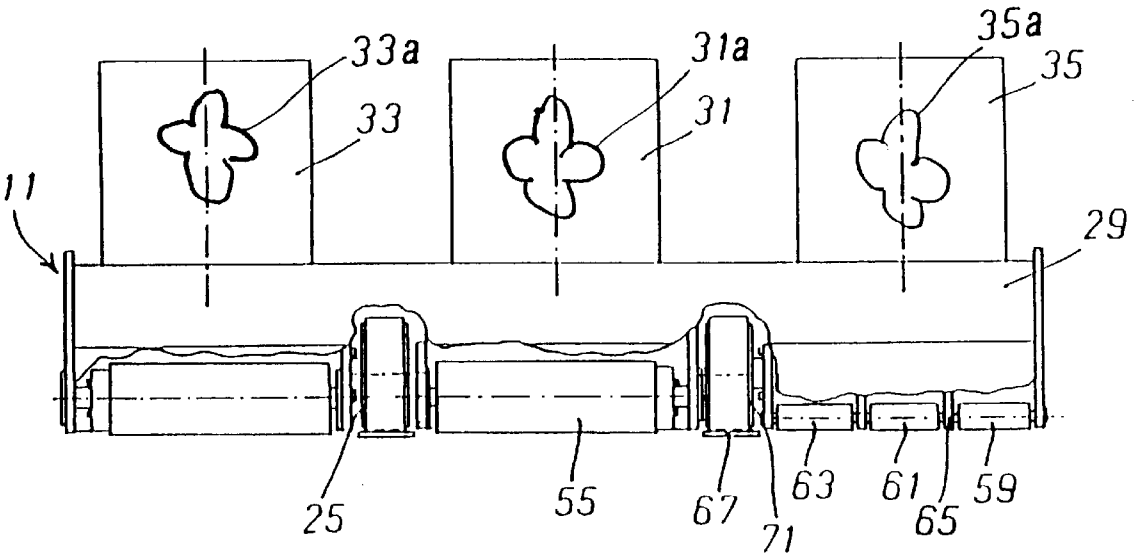
FIG. 3 is a view, as seen in the direction of arrow A in FIG. 1 of the sheet-refeeding system of the present invention, with a partial cutout.
Figure 4:
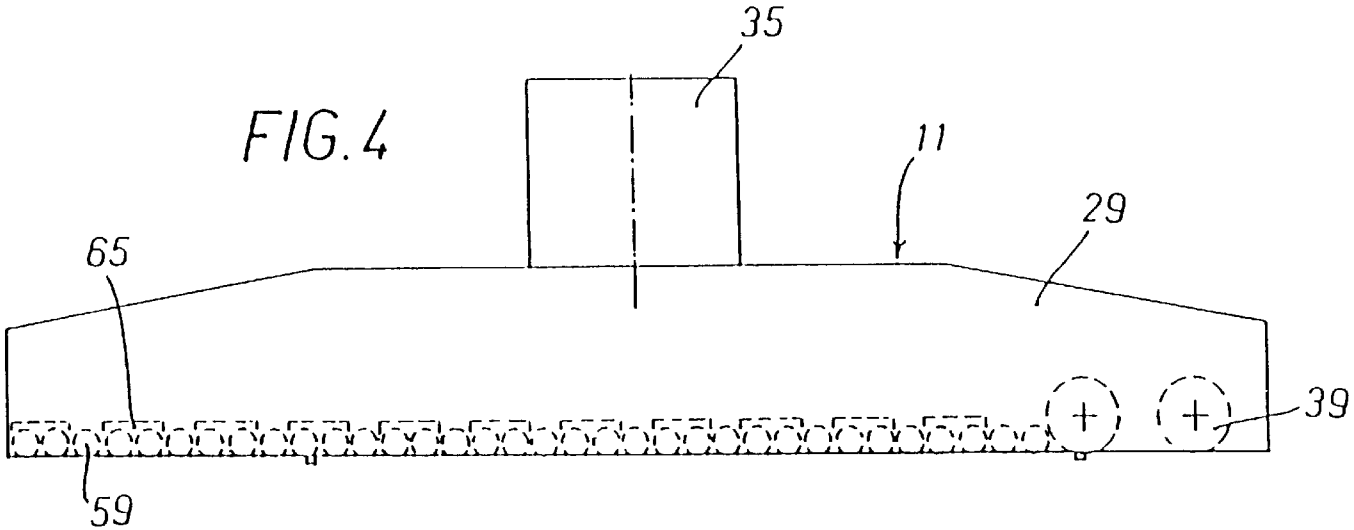
FIG. 4 is a side view of the sheet-refeeding system of FIG. 2.

With reference to FIGS. 2 to 4, the sheet-refeeding system of the printing and die cutting machine for corrugated board sheets shown in FIG. 1 will now be described in greater detail. System 11 for vacuum-refeeding sheets on a conveying line includes a support and upper closure structure 29 shaped as a hood, a central box 31 located on the upper side of the support structure 29 and communicating with the support structure 29 the lower side thereof and being open towards this structure 29, and at least a pair of side boxes 33 and 35, each located on either side of a central box 31, along a transverse direction with respect to the sheet-traveling direction. The side boxes 33 and 35 are also located on the upper side of the support structure 29 and also communicate with support structure 29 at their open lower sides.

In each box, namely the central box 31 and side boxes 33 and 35, a suction device 31*a*, 33*a* and 35*a* is placed, which is composed of a helical fan (schematically shown in FIG. 3). The speed of the helical fan can be fixed or variable according to the end user's needs. The suction device 31*a* contained in the central box 31 is always operating to subject the sheets to an upwardly-directed suction force, starting from the force for minimum sheet-size that is a feat of the machine. On the contrary, the suction devices 33*a* and 35*a* included in the side boxes 33 and 35 are usually at rest and are actuated only to transport larger-sized sheets.

As can be seen from FIG. 2, in the lower part of the support structure 29, a sheet-conveying unit 37 is fixed, that is composed of a first sheet-dragging, motored knurled roller 39, located at the inlet of the refeeding system 11 immediately downstream of the outlet roller 5 of the sheet-printing unit 1. The first knurled roller 39 performs the first sheet-grasping and traveling action and therefore has a length that is approximately equal to the transverse length of the whole sheet-conveying line.

Immediately downstream of the first knurled roller 39, at least one second motored knurled roller is located (in the preferred embodiment described herein as least three rollers 41, 43 and 45 are provided), also used to drag the sheets. In the preferred embodiment, since the side knurled rollers 41 and 45 only operate for quite large sheets, and since it is necessary to provide means to forward-drag the sheets on the line, all three side knurled rollers 41, 43 and 45 are of the same length, that is less than the length of the first knurled roller 39, which thereby allows the insertion between each pair of rollers 41, 43, and 43, 45, of idle pulley 47, whose use will be described below. The knurled rollers 41, 43 and 45 rotate with the same speed as that of the roller 39 due to the presence of an intermediate roller 46 (FIG. 1).

These rollers are rotated by any suitable external transmission device or unit (not shown) connected to the gears of the printing unit 1.

The four knurled rollers 39, 41, 43 and 45 form the initial sheet-travel section, where the "vacuum" condition is created for an effective grasp and following conveyance of the sheets themselves. In order to generate such vacuum condition, a covering plate 49 is provided which has a side slit 49*a* through which the lower part of the first knurled roller 39 projects, and which rotates, at least three side slits 41*a* in succession, through which the lower parts of the three second knurled rollers 41, 43 and 45 project, and which also rotate, and a plurality of rows of small circular holes 51 to let air, sucked by the upper helical fans, pass. As is apparent from FIG. 2, the rows of small holes 51 are positioned upstream, downstream and in the gap between the two rows of side slits 41*a*, 49*a*.

After having been taken and conveyed by the knurled rollers 39, 41, 43 and 45 at the same speed at which they had been printed, the sheets pass onto a central sheet-conveying line 53, composed of a plurality of idle guide rollers 55. The central line 53 is located below the central box 31 and is immediately downstream of the central knurled roller 43 of the row of knurled rollers 41, 43, 45. On the central line 53 the central suction device 31*a* is operating, that, though not vacuum-operating, generates a suction force that is sufficient to keep the sheets in contact with the line itself for the following conveyance. The central sheet-conveying line 53 is always active, as well as the helical fan 35*a* above this line because the sheets always pass above the sheet-conveying line.

There are also at least two side sheet-conveying lines 55*a* and 57, each of which is composed of at least three small idle drive rollers 59, 61 and 63, coupled for rotating independently from each other to reduce dragging inertia. In the two gaps formed between the sides of the small drive rollers 59 and 61, and 61 and 63, respectively, there are two small sheet-guiding plates 65, that operate according to the width of the sheets to be conveyed, to prevent suction of sheets into the gaps between the small drive rollers 59, 61 and 63. The side lines 55*a* and 57 are not always operating. When the side lines 55*a* and 57 operate not all three small rollers 59, 61 and 63, of which they are composed, are always rotating. Each of the side lines 55*a* and 57 is located below one of the side boxes 33 and 35, respectively, and is immediately downstream of the side knurled rollers 41 and 45.

To guarantee a forward-dragging movement of the sheets and to be able to adjust the traveling speed of the sheets to the speed of the downstream-located die cutting unit 13, at least two toothed timing belts 25 are provided, each respectively placed between the central line 53 and one of the side conveying lines 55*a* and 57. These toothed timing belts 25 include on the external surface thereof a plurality (in the preferred embodiment there are three small blocks) of small blocks 67 to drag the sheets, and each of the belts 25 is driven by a driving pulley 71 and by the idle pulley 47 already mentioned with reference to FIG. 1. The small blocks 67 act on the sheets from above to drag the sheets and due to the arrangement of the belts 25 between the lines 53, 55*a* and 57, their transverse adjustment is avoided, which was required in the previously known machines. The driving pulley 71 is driven by the d.c. motor 17 through the already-described transmission or driving element 19, 21 and 23 and therefore the outlet speed of the sheets is made equal to the speed of the inlet roller 15 of the die cutting unit 13 downstream of the refeeding system 11. FIG. 2 shows, as an example, a corrugated board sheet 69 pushed by the small blocks 67 positioned on the toothed timing belts 25 and conveyed to the outlet of the refeeding system 11.

A further feature of the present invention allows to solve the problems of interference between small blocks 67 and sheets, immediately before they enter the die cutting unit 13. Here, the small blocks 67 could nick and warp the sheets. Therefore, it has been provided that the pitch between small blocks 67 is less than the development of the downstream die cutter-holding cylinder 27, and consequently the toothed timing belts 25 move with a traveling speed that is less than the speed of the die cutter-holding cylinder 27 and thereby prevent such an interference.

Although the present invention has been described with reference to preferred embodiments, numerous modifications and rearrangements can be made, and still the result will come within the scope of the invention.

I claim:

1. A sheet-refeeding system for vacuum refeeding sheets, provided in a printing and die cutting machine also having a sheet-printing unit and a die cutting unit including a die cutter-holding cylinder, the system comprising:

a support closure structure shaped as a hood having an interior, said support closure structure having an upper side and a bottom side;

a central box located on said upper side of said support closure structure, said central box being open towards said support closure structure, whereby the interior of said box communicating at a lower side thereof with the interior of said support structure;

a suction device positioned inside said central box; and a sheet-conveying unit fixed to said support closure structure at said lower side of said support closure structure, said sheet-conveying unit including:

a first sheet-dragging motored knurled roller, located at an inlet of the refeeding system immediately downstream of an outlet roller of said sheet-printing unit;

at least one second sheet-dragging motored knurled roller, placed at the inlet of the refeeding system immediately downstream of said first sheet-dragging motored knurled roller;

a covering plate at which said first sheet-dragging motored knurled roller and said at least one second sheet-dragging motored knurled roller are positioned, said covering plate having at least two side slits through which said first sheet-dragging motored knurled roller and at least one second sheet-dragging motored knurled roller project to contact sheets being conveyed, said covering plate also having a plurality of rows of small holes, said rows of small holes being positioned upstream, downstream and between said side slits;

at least one sheet-conveying line composed of a plurality of idle drive rollers, said sheet-conveying line being located below said central box and being immediately downstream of said at least one second sheet-dragging motored knurled roller;

a driving pulley;

an idle pulley; and at least a pair of toothed belts each located at a side of said sheet-conveying line, each of said toothed belts including on an external surface thereof a plurality of small dragging blocks acting on the sheets being conveyed from above to drag the sheets being conveyed, each of said toothed belts being driven by said driving pulley and said idle pulley to adjust an outlet speed of the sheets to the speed of inlet rollers of said die cutting unit downstream of the sheet refeeding system.

2. The sheet-refeeding system according to claim 1, wherein a pitch included between said small dragging blocks and said toothed belts is less than a development of the die cutter-holding cylinder downstream, said toothed belts moving with a traveling speed that is less than the speed of said die cutter-holding cylinder to prevent interference between said small dragging blocks and the sheets at an outlet of the sheet-refeeding system.

3. The sheet-refeeding system according to claim 1, and further comprising at least a pair of side boxes located at each respective side of said central box in a direction transverse to a sheet-traveling direction, each side box including a suction device.

4. The sheet-refeeding system according to claim 3, wherein each suction device is composed of a helical fan that generates a vacuum condition in a part of said sheet-conveying unit, where said first sheet-dragging knurled roller and at least one second sheet-dragging knurled roller are located, and create a constant suction force towards the sheets being conveyed in a remaining part of said sheet-conveying unit.

5. The sheet-refeeding system according to claim 1, wherein said sheet-conveying unit includes three second sheet-dragging motored knurled rollers and three sheet conveying lines, said three second sheet-dragging motored knurled rollers being all of same length, and said three conveying lines include a central conveying line and a pair of side conveying lines, each of said side lines being composed of at least three small idle drive rollers coupled for rotation independently from each other and at least a pair of sheet-guiding plates, said sheet-guiding plates each being longitudinally inserted, respectively, between two of said small idle drive rollers, said sheet-guiding plates preventing suction of the sheets being conveyed in gaps between said small idle drive rollers.

* * * * *